US005425176A

United States Patent [19]

Brainerd et al.

[11] Patent Number: 5,425,176

[45] Date of Patent: Jun. 20, 1995

[54] HANDLE FOR ICE AXE

[75] Inventors: Charles Brainerd; John Bercaw; William Belcourt, all of Salt Lake City, Utah

[73] Assignee: Black Diamond Equipment, Ltd., Salt Lake City, Utah

[21] Appl. No.: 12,010

[22] Filed: Feb. 1, 1993

[51] Int. Cl.[6] ..... B26B 23/00; B25G 1/10

[52] U.S. Cl. ..... 30/308.1; 16/111 R; 7/145; 7/167; 81/489

[58] Field of Search ..... 30/165, 308.1, 312, 30/313; 16/111 R, 110 R; 7/144, 145, 146, 159, 167; 81/489

[56] References Cited

U.S. PATENT DOCUMENTS

| | | | |
|---|---|---|---|
| D. 124,300 | 12/1940 | Morris | 30/165 |
| D. 203,575 | 1/1966 | Dobbs | 7/159 |
| 982,564 | 1/1911 | Baker | 30/308.1 |
| 1,054,823 | 3/1913 | Burks | 30/308.1 |
| 2,798,292 | 7/1957 | Bishaf | 30/308.1 |
| 3,252,489 | 5/1966 | Huston etal. | 30/308.1 |
| 3,559,340 | 2/1971 | Good | 30/308.1 |
| 3,735,434 | 5/1973 | Penberthy | 30/308.1 |
| 4,023,606 | 5/1977 | Kneissl | 30/308.1 |

*Primary Examiner*—Richard K. Seidel

*Attorney, Agent, or Firm*—Thorpe North & Western

[57] ABSTRACT

An ice axe device comprising a handle having a gripping end and a working end and an impact member attached at the working end. The gripping end is configured about its longitudinal axis with a smaller, forward curvature and a larger, rearward curvature. The smaller, forward curvature is approximately defined by a radius slightly smaller than a corresponding radius of an arc formed at an inner surface of the user's fingers when wrapped about that portion of the gripping end. The larger, rearward curvature is approximately defined by a larger radius which is slightly smaller than a corresponding radius of an arc formed by a users palm and a proximate inside portion of an extending thumb when wrapped around the gripping end.

22 Claims, 3 Drawing Sheets

HANDLE FOR ICE AXE

BACKGROUND OF THE INVENTION

1. Field of Invention

This invention pertains to handles for ice axes used for ice or mountain climbing. More particularly, the present invention relates to an improved handle which provides an improved grip and orientation for ice axe applications.

2. Prior Art

Ice climbing and mountain climbing which entails scaling ice formations each require the use of an ice axe for forming foot holds and positioning anchor pins, as well as for clearing obstacles. Because mobility of the climber is severely limited, proper orientation of the ice axe in the hand of the climber is an important element of safety and effectiveness. A preferred axe orientation positions the handle in a natural, consistent grasp with the spiked or working member of the axe in a slightly downward, inclined configuration. This applies a natural downward force upon impact at the ice, without the need of special positioning within the climbers hand.

Conventional ice axes utilize a handle which has a round or oval cross section. As a consequence, ice climbers have difficulty in controlling the swing of the axe accurately. This arises in part because the handle orientation within the hand can easily rotate or shift without detection. With a round handle, there is no reference of handle shape to assist in handle orientation. Although an oval shape offers some directional orientation, inadvertent lateral rotation of the handle during use makes precision accuracy very difficult.

Maximum efficiency can only be realized when the climber is able to quickly grasp and orient the axe in the same position within his hand with each use. This aspect of maintaining axe orientation in the same, duplicatable position is limited with conventional round or oval designs because the symmetry of the handle cross-section makes physical sensing of a unique orientation difficult. Without this sense of exact orientation, the climber is unable to maintain exact control of the impact spike on a repeated basis.

OBJECTS AND SUMMARY OF THE INVENTION

It is therefore an object of the present invention to provide an improved ice axe which facilitates exact positioning within the user's hand.

It is yet another object of this invention to provide an ice axe whose handle is configured to nest in a preferred, single position when grasped by the user.

It is a further object of the present invention to provide an ergonomic ice axe grip member.

These and other objects are realized in an ice axe device which comprises a handle having a gripping end and a working end. An impact member or spike is attached at the working end of the handle and is configured for use as an ice axe. The gripping end of the handle is configured about a longitudinal axis with a smaller forward curvature and a larger rearward curvature. The forward curvature provides a radius corresponding to a radius of an arc formed by a user's fingers wrapped around a forward portion of the gripping end of the handle. The rearward curvature provides a larger radius corresponding to a radius of an arc formed by a user's palm and proximate portion of an extending thumb wrapped around a rearward portion of the gripping end of the handle. The device may also be implemented with a handle sleeve which is similarly configured with the forward and rearward radii and configuration.

Other objects and features of the present invention will be apparent to those skilled in the art, based on the following detailed description, taken in combination with the accompanying drawings.

DETAILED DESCRIPTION OF THE PREFERRED EMBODIMENT

Figures 1, 2:
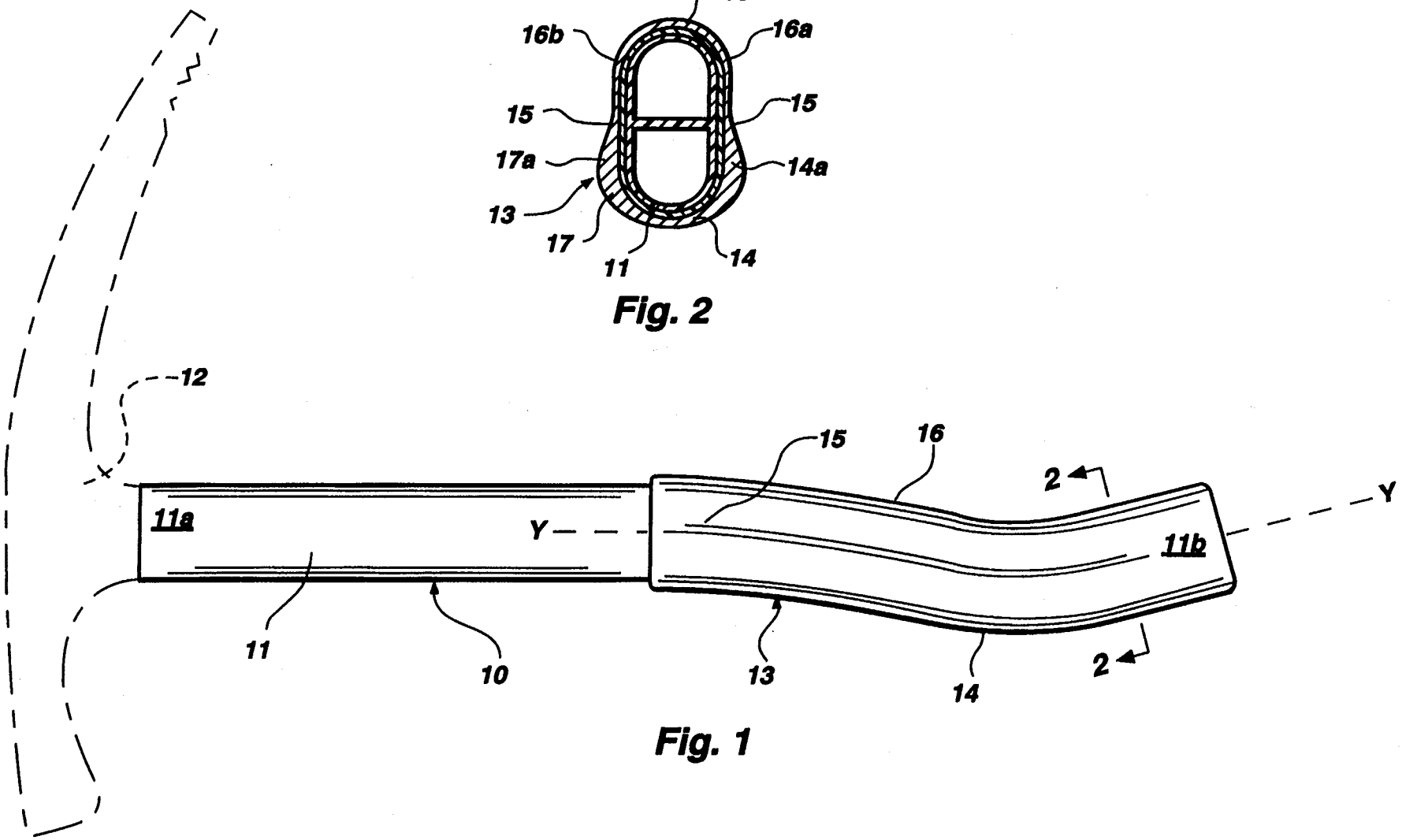
FIG. 1 illustrates a side plan view of an ice axe incorporating one embodiment of the present invention.
FIG. 2 shows a cross-section of the handle of the ice axe of FIG. 1, taken along the lines 2—2.

Referring now to the drawings:

FIG. 1 identifies one embodiment of an ice axe 10 which is generally comprised of a handle 11 and a spike or working member 12 which is anchored on a working end 11*a* of the handle. The handle may be constructed of wood, plastics, or other materials suitable for application of the tool. A preferred material for the ice axe as disclosed herein is a fiber reinforced plastic of conventional composite construction. The working member 12 is typically made of steel. It may be configured in any conventional manner suitable to the climber.

Figure 3:
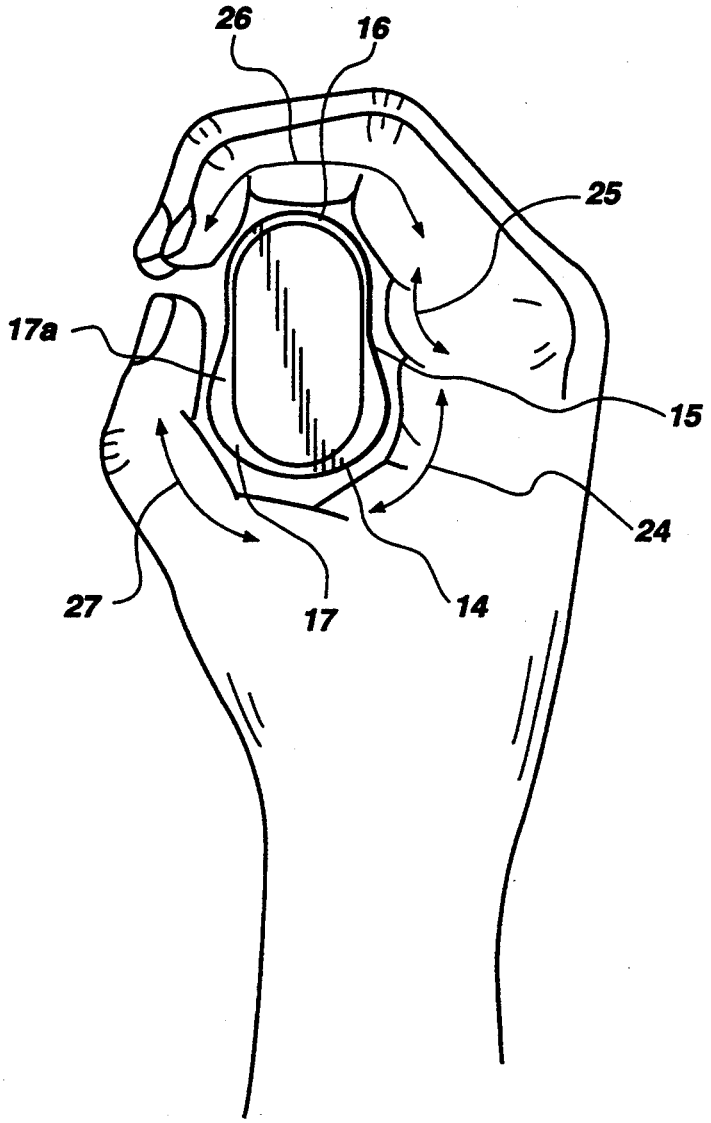
FIG. 3 depicts a graphic representation of the handle being grasp by the user, showing preferred curvature features of the handle in cross-section.

The opposite end of the handle is referred to as a gripping end 11*b*. The gripping end 11*b* of the handle is configured about a longitudinal axis Y with a smaller, forward curvature 16 and a larger, rearward curvature represented by arc segments 14 and 17. The arc segments 14 and 17 may be of common dimension as illustrated in the figures, or they may be slightly different to accommodate a more unique hand configuration. Similarly, these different arc segments may be adjusted in radius to particularly favor a right or left handed person respectively. For example, arc segment 14 may be larger than 17 for a right handed person such as the grasp illustrated in FIG. 3. Conversely, the arc segment 17 could be larger for a left handed person, so that the thumb wraps around the narrow arc segment.

The relative difference in size between the forward and rearward curvatures is provided to imbalance the symmetry of the handle and assist the user to identify a comfortable, unique feel for the correct grasp of the handle. The smaller, forward curvature 16 comprises a radius slightly smaller than a corresponding radius of an arc 26 formed by an interior surface of a user's fingers wrapped around a forward portion 16 of the gripping end of the handle. Similarly, the larger, rearward curvature comprises a larger radius corresponding to a radius of an arc formed by the interior surface of an inside of a user's palm and the proximate inside portion of an extending thumb wrapped around the rearward portion of the gripping end of the handle. It will be recognized by those skilled in the art that the respective curvatures of the three segments of the finger naturally form an arc 26 which is significantly smaller in radius than the arc formed by the palm and thumb extension.

The configuration of the ice axe handle as set forth herein provides a more natural fit to the user's natural grasp, with the smaller curvature always oriented in the forward direction. This provides a directional element to the grasp which will always orient the spike in a forward position. By conforming the forward and rearward curvatures to the natural shape of the grip, a unique feel is established for each user which can be quickly reproduced with each grasp. Furthermore, an orientation of the handle which is inaccurate can be readily sensed because of the difference in the feel of the hand in its grasp.

Although general principles have been set forth as guidelines for design of an improved axe handle in accordance with the present invention, particular embodiments with dimensions are given as examples. Generally, these dimensions will have a ratio of radii of the respective forward and rearward curvature falls within a range of 4:10 to 7.5:10. For ice axe handles, a more preferred ratio of radii of the respective forward and rearward curvature falls within a range of 5:10 to 6.5:10. The most preferred ratio of radii of the respective forward and rearward curvature approximately equals 6:10.

Within the range of these ratios, the radius of the forward curvature of the gripping end of the handle is within the range of 0.3 to 0.5 inches and the radius of the rearward curvature is within the range of 0.55 to 0.7 inches. In the more preferred mode, the radius of the forward curvature is approximately 0.375 inches and the radius of the rearward curvature is approximately 0.625 inches.

As shown in the figures, the preferred embodiment provides that the forward 16 and rearward curvatures 14, 17 converge at opposing junctions at opposite sides of the gripping end of the handle to form lateral interconnecting curvatures 15. These respective interconnecting curvatures generally have radii within a range of 0.5 to 1.5 inches. In the preferred embodiment, the respective interconnecting curvatures have radii approximately equal to one inch.

The general dimensions of the handle length, width and thickness will vary for different sizes of hands. As a representative set of dimensions found to be most advantageous for the specific radii set forth above, a forwardmost portion of the forward curvature is spaced at a separation distance from a rearwardmost portion of the rearward curvature by a distance of 1.6 to 1 inches. More specifically, the forwardmost portion of the forward curvature is spaced at a separation distance from a rearwardmost portion of the rearward curvature by a distance of 1.4 inches.

Figure 5:
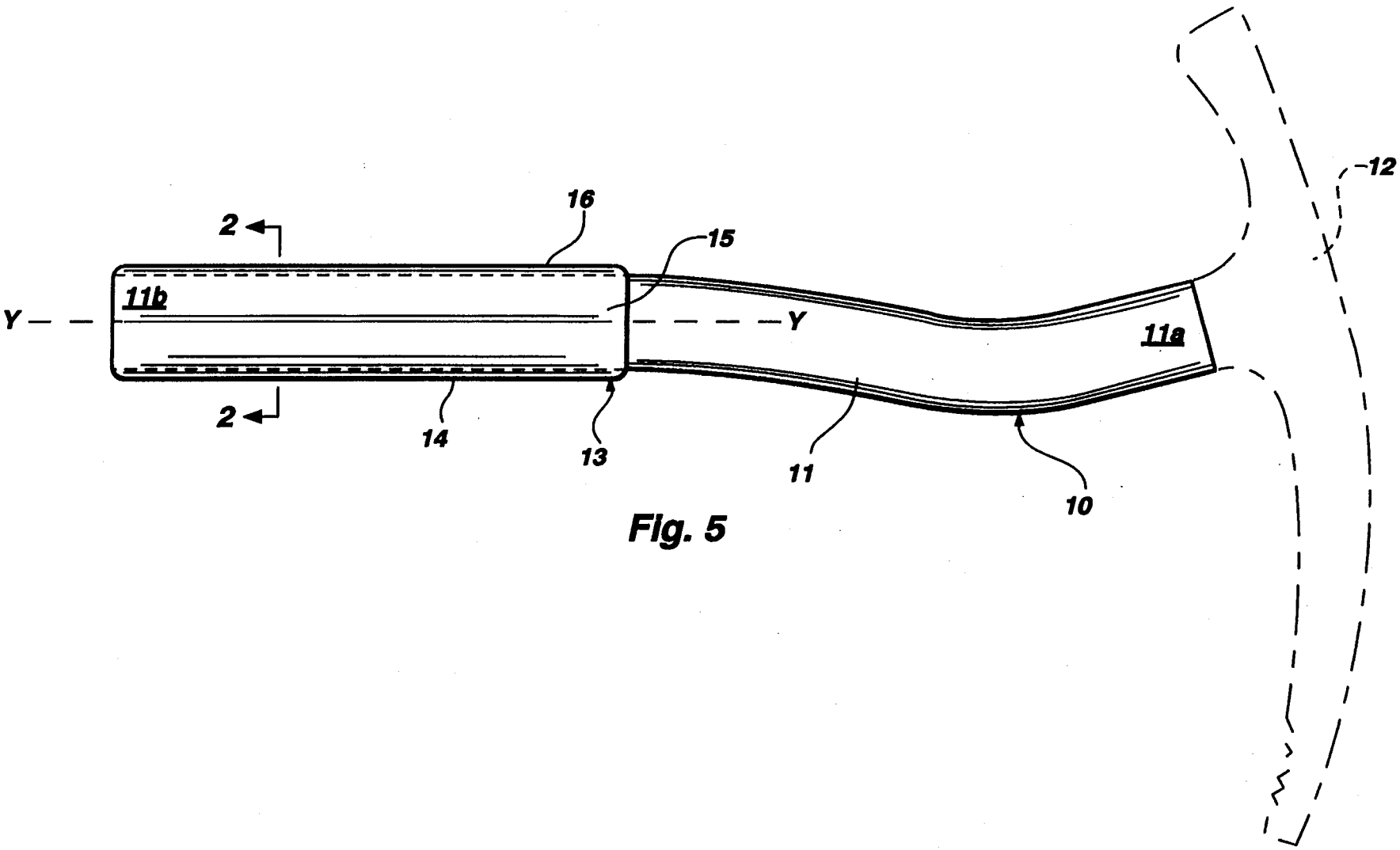
FIG. 5 shows a side plan view of an ice ax incorporating an alternate embodiment of present invention.

The handle may be configured with a straight construction from the gripping end to the working end, or may be bent to an elbow as illustrated in FIG. 1. This elbow section is positioned at the gripping end, as shown in FIG. 1, or at the working end, as shown in FIG. 5, so as to provide an inclination of the impact member toward the handle of 15 to 30 degrees from a squared orientation of 90 degrees. Thus, the working end is inclined 15 to 30 degrees from a longitudinal axis Y defined by the gripping end. The most preferred inclination is approximately 27 degrees from a squared orientation of 90 degrees, the working end being inclined 27 degrees from a longitudinal axis Y defined by the gripping end.

The features of the gripping end may be directly injection molded or formed as an integral gripping end to the handle or may be molded or coated onto the preformed composite handle as a separate gripping end formed by a coating of polymer applied to develop the respective forward and rearward curvatures. This gripping end may also be molded as a sleeve member which can be slid onto a handle of conventional cross-section. This embodiment of the invention enable retrofit of existing axe handles with the favorable hand configuration.

Figure 4:
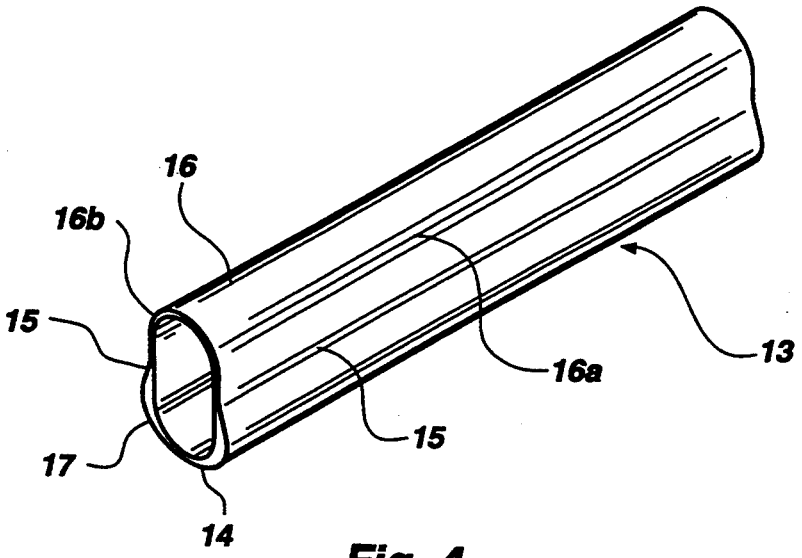
FIG. 4 shows a perspective view of sleeve for fitting about an ax handle incorporating the aspects of the present invention.

In this instance, the grip device comprising a sleeve member configured to fit snugly around a gripping end of the axe handle, with the sleeve member being configured about a longitudinal axis with an exterior surface having a forward curvature and a larger rearward curvature. The forward curvature comprises a radius corresponding to a radius of an arc formed by a user's fingers wrapped around a forward portion of the gripping end of the handle. The rearward curvature comprises a larger radius corresponding to a radius of an arc formed by a user's palm and proximate portion of an extending thumb wrapped around a rearward portion of the gripping end of the handle. A similar range of radii and other dimensions as set forth above could be applied to the sleeve embodiment. This embodiment is illustrated in FIG. 4, with numerical identifications corresponding to the previous descriptive elements represented in FIGS. 1 to 3.

It will be apparent to those skilled in the art that the various specific embodiments described in this disclosure are merely exemplary of the inventive principles and features of this invention as set forth in the accompanying claims and are not to be viewed as otherwise limiting.

We claim:

1. An ice axe device comprising:

a handle having a gripping end and a working end;

an impact member attached at the working end of the handle and configured for use as an ice axe;

said gripping end of the handle being configured about a longitudinal axis with a relatively smaller, forward curvature as compared to a relatively larger, rearward curvature, and wherein the forward curvature and the rearward curvature are separated by lateral, generally parallel sides said, sides forming concave junctions with said larger, rearward curvature;

said smaller, forward curvature being approximately defined by a radius slightly smaller than a corresponding radius of an arc formed at an inner surface of a user's fingers wrapped around a forward portion of the gripping end of the handle;

said larger, rearward curvature being approximately defined by a larger radius slightly smaller than a corresponding radius of an arc formed by the user's palm and approximate inside portion of an extending thumb wrapped around a rearward portion of the gripping end of the handle.

2. A device as defined in claim 1, wherein a ratio of radii of the respective forward and rearward curvature falls within a range of 4:10 to 7.5:10.

3. A device as defined in claim 1, wherein a preferred ratio of radii of the respective forward and rearward curvature falls within a range of 5:10 to 6.5:10.

4. A device as defined in claim 3, wherein the radius of the forward curvature of the gripping end of the handle is within the range of 0.3 to 0.5 inches and the radius of the rearward curvature is within the range of 0.55 to 0.7 inches.

5. A device as defined in claim 4, wherein a forwardmost portion of the forward curvature is spaced at a separation distance from a rearwardmost portion of the rearward curvature by a distance of 1.6 to 1 inches.

6. A device as defined in claim 4, wherein a forwardmost portion of the forward curvature is spaced at a separation distance from a rearwardmost portion of the rearward curvature by a distance of 1.4 inches.

7. A device as defined in claim 1, wherein a most preferred ratio of radii of the respective forward and rearward curvature approximately equals 6:10.

8. A device as defined in claim 7, wherein the radius of the forward curvature is approximately 0.375 inches and the radius of the rearward curvature is approximately 0.625 inches.

9. A device as defined in claim 1, wherein the handle is configured with a straight construction from the gripping end to the working end.

10. A device as defined in claim 1, wherein the handle is configured with an elbow section between the gripping end and the working end and within an upper half of the handle which includes the working end, said elbow section providing an inclination of the impact member toward the handle of 15 to 30 degrees from a squared orientation of 90 degrees, the working end being inclined 15 to 30 degrees from a longitudinal axis defined by the gripping end.

11. A device as defined in claim 1, wherein the handle is configured with an elbow section between the gripping end and the working end and within an upper half of the handle which includes the working end, said elbow section providing an inclination of the impact member toward the handle of approximately 27 degrees from a squared orientation of 90 degrees the working end being inclined 27 degrees from a longitudinal axis defined by the gripping end.

12. A device as defined in claim 1, wherein the gripping end includes a coating of polymer to form the respective forward and rearward curvatures.

13. A grip device used with an axe handle, said grip device comprising:

a sleeve member configured to fit snugly around a gripping end of the axe handle, said sleeve member being configured about a longitudinal axis with an exterior surface having a smaller, forward curvature and a larger, rearward curvature wherein the smaller, forward curvature is separated from the larger, rearward curvature by generally straight and parallel extending lateral sides, each of said sides forming a generally concave junction with said larger, rearward curvature, said smaller, forward curvature being approximately defined by a radius slightly smaller than a corresponding radius of an arc formed at an inner surface of a user's fingers wrapped around a forward portion of the gripping end of the handle;

said larger, rearward curvature being approximately defined by a larger radius slightly smaller than a corresponding radius of an arc formed by a user's palm and a proximate inside portion of an extending thumb wrapped around a rearward portion of the gripping end of the handle, said forward curvature comprising a radius corresponding to a radius of an arc formed by a user's fingers wrapped around a forward portion of the gripping end of the handle.

14. A device as defined in claim 13, wherein a preferred ratio of radii of the respective forward and rearward curvature falls within a range of 5:10 to 6.5:10.

15. A device-as defined in claim 13, wherein a most preferred ratio of radii of the respective forward and rearward curvature approximately equals 6:10.

16. A device as defined in claim 15, wherein the radius of the forward curvature of the gripping end of the handle is within the range of 0.3 to 0.5 inches and the radius of the rearward curvature is within the range of 0.55 to 0.7 inches.

17. A device as defined in claim 16, wherein the radius of the forward curvature is approximately 0.375 inches and the radius of the rearward curvature is approximately 0.625 inches.

18. A device as defined in claim 13, wherein said forward and rearward curvatures converge at opposing junctions at opposite sides of the gripping end of the handle to form lateral interconnecting curvatures.

19. A device as defined in claim 18, wherein the respective interconnecting curvatures have radii within a range of 0.5 to 1.5 inches.

20. A device as defined in claim 19, wherein the respective interconnecting curvatures have radii approximately equal to one inch.

21. A device as defined in claim 13, wherein a forwardmost portion of the forward curvature is spaced at a separation distance from a rearwardmost portion of the rearward curvature by a distance of 1.6 to 1 inches.

22. A device as defined in claim 21, wherein a forwardmost portion of the forward curvature is spaced at a separation distance from a rearwardmost portion of the rearward curvature by a distance of 1.4 inches.

* * * * *